US006406132B1

(12) United States Patent
Sundström

(10) Patent No.: US 6,406,132 B1
(45) **Date of Patent: *Jun. 18, 2002**

(54) PRINTING APPARATUS OF TONER JET TYPE HAVING AN ELECTRICALLY SCREENED MATRIX UNIT

(75) Inventor: Per Sundström, Järfälla (SE)

(73) Assignee: Array Printers AB, Vastra Frolunda (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/142,702

(22) PCT Filed: Mar. 11, 1997

(86) PCT No.: PCT/SE97/00416

§ 371 (c)(1),
(2), (4) Date: Sep. 11, 1998

(87) PCT Pub. No.: WO97/34205

PCT Pub. Date: Sep. 18, 1997

(30) Foreign Application Priority Data

Mar. 12, 1996 (SE) ..... 9600948

(51) Int. Cl.[7] ..... B41J 2/06

(52) U.S. Cl. ..... 347/55

(58) Field of Search ..... 347/55, 151, 120, 347/141, 154, 103, 123, 111, 159, 177, 128, 131, 125, 158; 399/271, 290, 292, 293, 294, 295; 216/4, 48

(56) References Cited

U.S. PATENT DOCUMENTS

| | | | |
|---|---|---|---|
| 3,566,786 | A | 3/1971 | Kaufer et al. |
| 3,689,935 | A | 9/1972 | Pressman et al. |
| 3,725,898 | A | 4/1973 | Canton |

(List continued on next page.)

FOREIGN PATENT DOCUMENTS

| | | |
|---|---|---|
| DE | 12 70 856 | 6/1968 |
| DE | 26 53 048 | 5/1978 |

(List continued on next page.)

OTHER PUBLICATIONS

"The Best of Both Worlds," Brochure of Toner Jet by Array Printers, The Best of Both Worlds, 1990.

International Congress on Advances in Non–Impact Printing Technologies, 1994, pp. 311–313.

E. Bassous, et al., "The Fabrication of High Precision Nozzles by the Anisotropic Etching of (100) Silicon", J. Electrochem. Soc.: Solid–State Science and Technology, vol. 125, No. 8, Aug. 1978, pp. 1321–1327.

*Primary Examiner*—Raquel Yvette Gordon
(74) *Attorney, Agent, or Firm*—Knobbe, Martens, Olson & Bear, LLP

(57) ABSTRACT

A printing apparatus includes heat treatment element, a rotatable feeder roll chargeable to a predetermined first potential, a support roll chargeable to a predetermined second potential, and a matrix in the form of a flexible printing circuit. The matrix has supply apertures, each supply aperture having a first inner diameter and being surrounded by an electrically conducting control ring configured to be charged to a predetermined third potential and having a second inner diameter. The third potential is selected to control corresponding supply apertures between an open state and a closed state. The matrix has an upper surface which is covered with a protective layer having through holes, each through hole having a second diameter which is at least equal to the inner diameter of the control rings. The protective layer includes a non-magnetic metal. The matrix and the control rings are covered, at upper surfaces and bore edges, with an electrically insulating layer. The feeder roll, the support roll and the matrix are configured to transfer a dry powder from the feeder roll through the supply apertures of the matrix to an object to be printed which is conveyed over the support roll. The powder deposited on the object is fixed by the heat treatment element.

18 Claims, 4 Drawing Sheets

U.S. PATENT DOCUMENTS 3,779,166 A 12/1973 Pressman et al.
3,815,145 A 6/1974 Tisch et al.
3,831,165 A 8/1974 Chivian et al.
3,877,008 A 4/1975 Payne
4,263,601 A 4/1981 Nishimura et al.
4,274,100 A 6/1981 Pond
4,307,169 A 12/1981 Malkan
4,320,408 A 3/1982 Iwasa et al.
4,340,803 A 7/1982 Ort
4,353,080 A 10/1982 Cross
4,382,263 A 5/1983 Fischbeck et al.
4,384,296 A 5/1983 Torpey
4,386,358 A 5/1983 Fischbeck
4,442,429 A 4/1984 Kolani et al.
4,470,056 A 9/1984 Galetto et al.
4,478,510 A 10/1984 Fujii et al.
4,491,855 A 1/1985 Fujii et al.
4,498,090 A 2/1985 Honda et al.
4,511,907 A 4/1985 Fukuchi
4,525,727 A 6/1985 Kohashi et al.
4,546,722 A 10/1985 Toda et al.
4,571,601 A 2/1986 Teshima
4,610,532 A 9/1986 Schamphelaere et al.
4,611,905 A 9/1986 Schamphelaere et al.
4,675,703 A 6/1987 Folland
4,717,926 A 1/1988 Holomi
4,743,926 A 5/1988 Schmidlin et al.
4,748,453 A 5/1988 Lin et al.
4,814,796 A 3/1989 Schmidlin
4,831,394 A 5/1989 Ochiai et al.
4,860,036 A 8/1989 Schmidlin
4,896,184 A 1/1990 Kamltamari et al.
4,903,050 A 2/1990 Schmidlin
4,912,489 A 3/1990 Schmidlin
5,028,812 A 7/1991 Bartky
5,036,341 A 7/1991 Larsson
5,038,159 A 8/1991 Schmidlin et al.
5,040,000 A 8/1991 Yokoi
5,049,469 A 9/1991 Pierce et al.
5,057,855 A 10/1991 Damoulh
5,072,235 A 12/1991 Slowik et al.
5,073,785 A 12/1991 Jansen et al.
5,083,137 A 1/1992 Badyal et al.
5,095,322 A 3/1992 Flelcher
5,121,144 A 6/1992 Larson et al.
5,128,662 A 7/1992 Failla
5,128,695 A 7/1992 Maeda
5,148,595 A 9/1992 Doggelt et al.
5,153,093 A 10/1992 Sacripante et al.
5,170,185 A 12/1992 Takemura et al.
5,181,050 A 1/1993 Bibl et al.
5,193,011 A 3/1993 Dir et al.
5,204,696 A 4/1993 Schmidlin et al.
5,204,697 A 4/1993 Schmidlin
5,214,451 A 5/1993 Schmidlin et al.
5,229,794 A 7/1993 Honman et al.
5,235,354 A 8/1993 Larson
5,237,346 A 8/1993 Da Costa et al.
5,256,246 A 10/1993 Kilamura
5,257,045 A 10/1993 Bergen et al.
5,270,729 A 12/1993 Stearns
5,274,401 A 12/1993 Doggett et al.
5,287,127 A 2/1994 Salmon
5,305,026 A 4/1994 Kazuo et al.
5,307,092 A 4/1994 Larson
5,311,266 A 5/1994 Madea
5,316,806 A * 5/1994 Yoshinaga et al.
5,328,791 A 7/1994 Ohta
5,329,307 A 7/1994 Takemura et al.
5,374,949 A 12/1994 Wada et al.
5,386,225 A 1/1995 Shibala
5,402,158 A 3/1995 Larson
5,414,500 A 5/1995 Furukawa
5,438,437 A 8/1995 Mizoguchi et al.
5,446,478 A 8/1995 Larson
5,450,115 A 9/1995 Bergen et al.
5,453,768 A 9/1995 Schmidlin
5,473,352 A 12/1995 Ishida
5,477,246 A 12/1995 Hirabayashi et al.
5,477,250 A 12/1995 Larson
5,506,666 A 4/1996 Masuda et al.
5,508,723 A 4/1996 Maeda
5,510,824 A 4/1996 Nelson
5,515,084 A * 5/1996 Larson ..... 347/55
5,523,827 A 6/1996 Snelling et al.
5,526,029 A 6/1996 Larson et al.
5,558,969 A 9/1996 Uyttendaele et al.
5,559,586 A 9/1996 Wada
5,600,355 A 2/1997 Wada
5,614,932 A 3/1997 Kagayama
5,617,129 A 4/1997 Chizuk, Jr. et al.
5,625,392 A 4/1997 Maeda
5,629,726 A * 5/1997 Yasama ..... 347/55
5,640,185 A 6/1997 Kagayama
5,650,809 A 7/1997 Kitamura
5,666,147 A 9/1997 Larson
5,677,717 A 10/1997 Ohashi
5,708,464 A 1/1998 Desie
5,729,817 A 3/1998 Raymond et al.
5,774,153 A 6/1998 Kuehnle et al.
5,774,159 A 6/1998 Larson
5,786,838 A 7/1998 Steinhaser et al.
5,801,729 A 9/1998 Kitamura et al.
5,805,185 A 9/1998 Kondo
5,818,480 A 10/1998 Bern et al.
5,818,490 A 10/1998 Larson
5,847,733 A 12/1998 Bern
5,850,244 A * 12/1998 Leonard et al. ..... 347/141
5,850,588 A 12/1998 Yoshikawa
5,867,191 A 2/1999 Luque
5,874,973 A 2/1999 Wakahara
5,889,548 A 3/1999 Albinsson
5,905,516 A 5/1999 Kagayama
5,956,064 A 9/1999 Sandberg
5,959,645 A 9/1999 Albinsson
5,963,767 A 10/1999 Habets et al.
5,966,151 A * 10/1999 Wakahara ..... 347/55
5,966,152 A 10/1999 Albinsson
5,971,526 A 10/1999 Klockar
5,975,683 A 11/1999 Smith et al.
5,984,456 A 11/1999 Bern
5,992,983 A * 11/1999 Takahashi et al.

FOREIGN PATENT DOCUMENTS

EP 0345 024 A2 6/1989
EP 0 323 143 A2 7/1989
EP 0352 997 A2 1/1990
EP 0377 208 A2 7/1990
EP 389 229 9/1990
EP 0660 201 A2 6/1995
EP 0703 080 A2 3/1996
EP 0715 218 A1 6/1996
EP 072 072 A2 7/1996
EP 0736 822 A1 10/1996
EP 0 743 572 A1 11/1996
EP 0752 317 A1 1/1997
EP 0 753 413 A1 1/1997
EP 0764 540 A2 3/1997
EP 0 795 792 A1 9/1997

| | | | |
|---|---|---|---|
| EP | 0816 944 | A1 | 1/1998 |
| EP | 0 844 095 | A3 | 5/1998 |
| GB | 2108432 | | 5/1983 |
| JP | 4426333 | | 11/1969 |
| JP | 5555878 | | 4/1980 |
| JP | 584671 | | 6/1980 |
| JP | 5587563 | | 7/1980 |
| JP | 5689576 | | 7/1981 |
| JP | 58044457 | | 3/1983 |
| JP | 58155967 | | 9/1983 |
| JP | 62 248662 | | 10/1987 |
| JP | 6213356 | | 11/1987 |
| JP | 01120354 | | 5/1989 |
| JP | 05220963 | | 8/1990 |
| JP | 04189554 | | 8/1992 |
| JP | 04 268591 | | 9/1992 |
| JP | 4282265 | | 10/1992 |
| JP | 05131671 | | 5/1993 |
| JP | 5208518 | | 8/1993 |
| JP | 93331532 | | 12/1993 |
| JP | 858143 | | 8/1994 |
| JP | 94200563 | | 8/1994 |
| JP | 06344567 | | 12/1994 |
| JP | 7246717 | A | 9/1995 |
| JP | 9048151 | | 2/1997 |
| JP | 09118036 | | 5/1997 |
| WO | PCT 9014960 | | 12/1990 |

* cited by examiner

PRINTING APPARATUS OF TONER JET TYPE HAVING AN ELECTRICALLY SCREENED MATRIX UNIT

FIELD OF THE INVENTION

The present invention generally relates to a printing apparatus of the k type which is used in various types of printers, for copying machines, in telefacsimile machines etc., and which operates with a dry print powder which is, in electrical way, applied to the object to be printed, for instance the paper, and which is thereafter fixed to the paper, generally by a heat treatment.

SUMMARY OF THE INVENTION

The invention is more particularly directed to a printing apparatus of said type which named a "toner jet" printing apparatus, and in which a dry print powder, generally named "toner", is, by a direct method, transferred from a rotating toner feeder roll, through bores of a fixed matrix in the form of a flexible printing circuit and down onto the object to be printed, for instance the paper which is conveyed over a support roll and in which the print powder which has been applied to the paper is finally fixed to the paper by a heat treatment.

The basis of said process is that two electrical fields are created for transferring toner from the toner feeder roll to the paper, namely a first electrical field between the toner feeder roll and the toner matrix, which electrical field is brought to invert polarity, and a second, preferably constantly downwards directed positive electrical field between the matrix and the support roll above which the paper is transferred.

The toner matrix is formed with a large number of very small through bores having a diameter of for instance 100–300 $\mu$m, and round each individual such bore an electrically conducting ring of a suitable metal, like copper, in the following referred to as "copper ring". Each copper ring can be charged with a positive potential, for instance +300V, which is higher than the potential of the toner feeder roll, which potential can for instance be between +5V and +100V, preferably about +50V, but which is less than the potential of the support roll for the paper, which potential can for instance be +1500V. When the electrically conducting ring is charged with a voltage said ring makes the belonging matrix bore become "opened" for letting toner down. If the matrix bore ring is, on the contrary, charged with a potential which is substantially lower than the potential of the toner feeder roll, for instance in that said ring is connected to ground, the belonging matrix bore becomes "closed" thereby preventing a letting down of toner.

The function is as follows:

- the toner powder gets a negative potential in that said toner particles rub against each other;
- the toner powder is supplied to the toner feeder roll, which is positively charged by a predetermined potential, often a potential which can be controlled between +0V and +100V, and the toner powder is distributed in an even, sufficiently thick layer over the toner feeder roll using a doctor blade;
- each bore of the matrix which corresponds to a desired toner dot is opened in that the matrix bore ring is charged with a positive potential which is higher than the potential of the toner feeder roll, for instance +300V; bores corresponding to non toner carrying portions remain connected to the ground, whereby said bores are to be considered "closed", thereby making it impossible to let toner through; the combination of opened matrix bores forms the image to be reproduced;
- depending on the difference in potential, for instance +50V to +300V=250V between the toner feeder roll and the toner matrix negatively charged toner particles are sucked down from the toner feeder roll to the matrix, and depending on the difference in potential between the toner matrix and the support roll mounted underneath same, for instance +300V to +1500V=+1200V the toner particles are moved on from the matrix and deposit on the paper above the support roll;
- the paper with toner deposited thereon is finally moved through a heat treatment apparatus in which the toner is fixed to the paper.

There is an almost linear relationship between the density of the current field and the traction force that said field exerts on the toner particles. The field has its greatest density just above the copper rings, and the density decreases from the ring edges towards the center of the bore. By reducing the potential of the toner feeder roll, which leads to an increasing difference in potential between the toner feeder roll and the matrix, it is possible to increase the amount of toner which is let down. An increase of the potential of the toner feeder roil leads a corresponding reduction of the amount of toner which is let down.

By connecting the copper ring of the matrix to the ground the direction of potential between the toner feeder roll is reversed from having been +250V in the direction downwards to be +50V in the direction upwards, and this makes negatively charged toner particles stick to the toner feeder roll, or be sucked back thereto, respectively.

In a certain embodiment of the printing apparatus the distance between the toner feeder roll and the matrix was about 0.1 mm, and the distance between the matrix and the support roll was about 0.6 mm. At normal printing the toner feeder roll has a voltage of +50V, and this gives a difference in potential to the matrix, which can have a voltage of +300V, of +250V between the toner feeder roll and the matrix. over the above mentioned distance of 0.1 mm this gives a field strength of 2.5V/$\mu$m.

The distance between the toner feeder roll and the support roll is about 0.7 $\mu$m, and the difference in potential is +1450V. This gives a field strength of 2 V/$\mu$m between the bottom surface of the matrix and the paper. The same electric field is present above the matrix and between the copper rings, and said field acts against the toner on the toner feeder roll, so that toner particles can be released from the toner feeder roll and can fall down on the upper surface of the matrix. As soon as the toner particles reach a copper ring, which is connected to ground (0V), said toner particles jump back to the toner feeder roll, and after having passed the copper ring said particles jump back down to the matrix again.

It also can happen that toner which is present above a conduit to a copper ring when the voltage changes from 0V to +300V can be sucked to the upper surface of the matrix and can be kept thereon, and this can prevent other toner particles from being fed into the matrix bore at the centre of the copper ring.

Toner which jumps up and down between the toner feeder roll and the upper surface of the matrix obstacles the flow of toner past the printing zone, and the jumping toner particles are often unloaded or may even change charge to the non-desired positive charge. Also, a slight amount of the toner particles normally have a "false" potential, generally 2–4% of the toner particles, and such falsely charged toner particles are often sucked both to the upper surface and to the bottom surface of the matrix.

SUMMARY OF THE INVENTION

The present invention is intended to solve the problem that toner particles jump between the toner feeder roll and the matrix, and said problem is solved in that a thin, protective metal layer is applied on the upper surface of the matrix. Said protective layer is formed with bores the diameters of which coincide with the outer diameter of the copper rings. The layer is given the same potential as that of the toner feeder roll, for instance +50V. The protective layer can have a thickness of 20–30 μm, and it is glued onto the upper surface of the matrix. The protective metal layer acts as an electric screen between the toner feeder roll and the matrix with the electric conduits thereof.

It is important that the bores of the protective layer each have a diameter which is at least the same as the outer diameter of the copper rings, since there would otherwise be a risque that the layer might screen off the field between the toner feeder roll and copper rings. In order to prevent that the material between the bores of the protective layer is too narrow the matrix is preferably formed with the copper rings on the top of the matrix base and with the inner diameter of the copper ring the same size as that of the bores of the matrix, whereby the copper rings may be used to a maximum for feeding toner particles from the toner feeder roll, through the matrix and down to the paper. In a matrix having a toner feeder bore with a diameter of about 190 μm the copper rings can have an outer diameter of for instance 250 μm, and in such case the bores of the protective layer can preferably be given a diameter of 250 μm.

If the toner feeder roll and the toner is of magnetic type the protective layer has to be of an unmagnetic material like of stainless steel, beryllium copper, hard nickel, brass, aluminum or another hard, unmagnetic material.

In order to eliminate the risque of flash over between the toner feeder roll and the matrix and between the copper rings and the support roll it is therefore necessary that the matrix bore ring be insulated. This is done in that the entire matrix is covered, for instance by an evaporation process, with an insulating substance which encloses all free surfaces and edges of the matrix, the matrix bores and the protective layer. An available method is the method named the Parylene® method (Union Carbide) according to which a polymeric insulation material named poly-para-xylene, using a vacuum apparatus, is applied to the matrix in a very well predetermined thickness. The material has an electric decomposition resistance of about 200 V/μm. This means that it is sufficient to use a layer having a thickness of only 2 μm for insulating an electric field of +250V between the toner feeder roll and the copper ring of the matrix.

DETAILED DESCRIPTION OF THE PREFERRED EMBODIMENT

Figure 1:
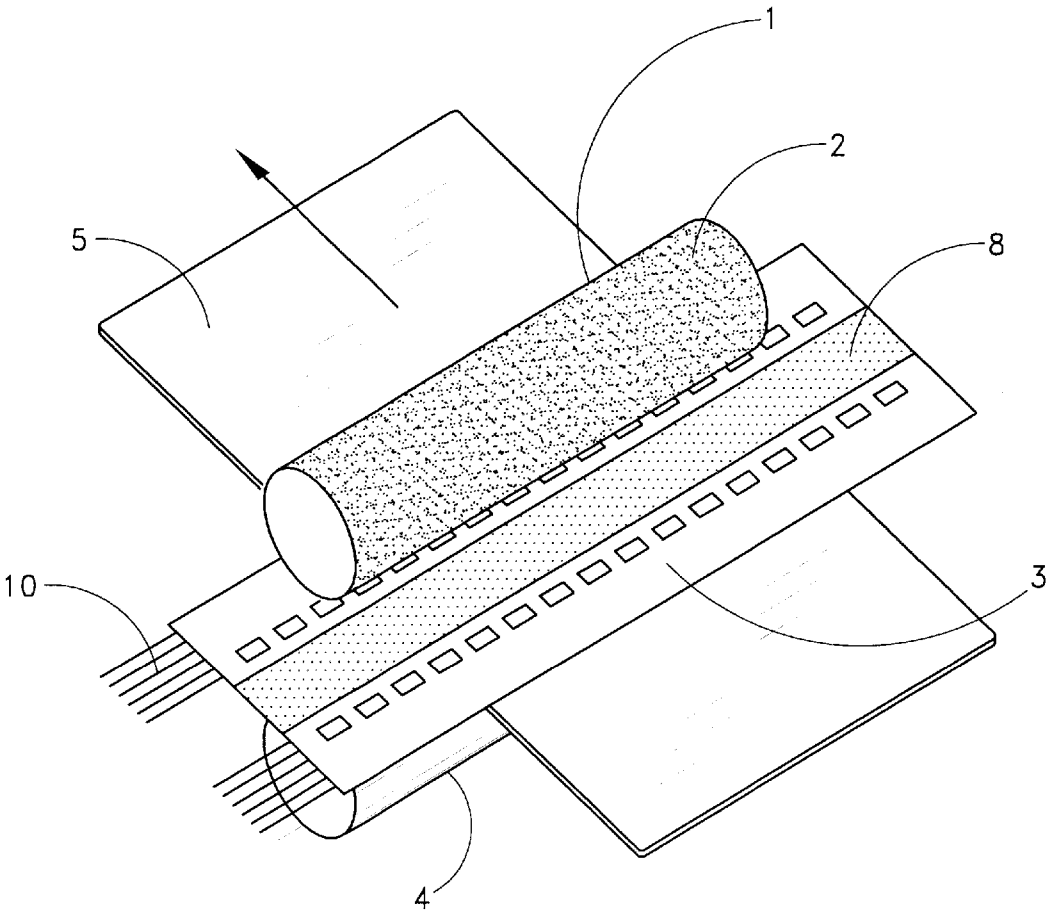
FIG. 1 shows schematically and in a perspective view the basic principle of a printing apparatus of toner-jet type.

Thus, in FIG. 1 there is diagrammatically shown a printing apparatus of toner jet type comprising a toner feeder roll 1 having an outer layer 2 of a toner powder of known type, a toner matrix 3 mounted underneath the toner feeder roll 1 and a support roll 4 mounted underneath the matrix 3 which support roll is arranged to support an object to be printed which is conveyed between the matrix 3 and the support roll 4, which object is normally a paper 5.

Figure 2:
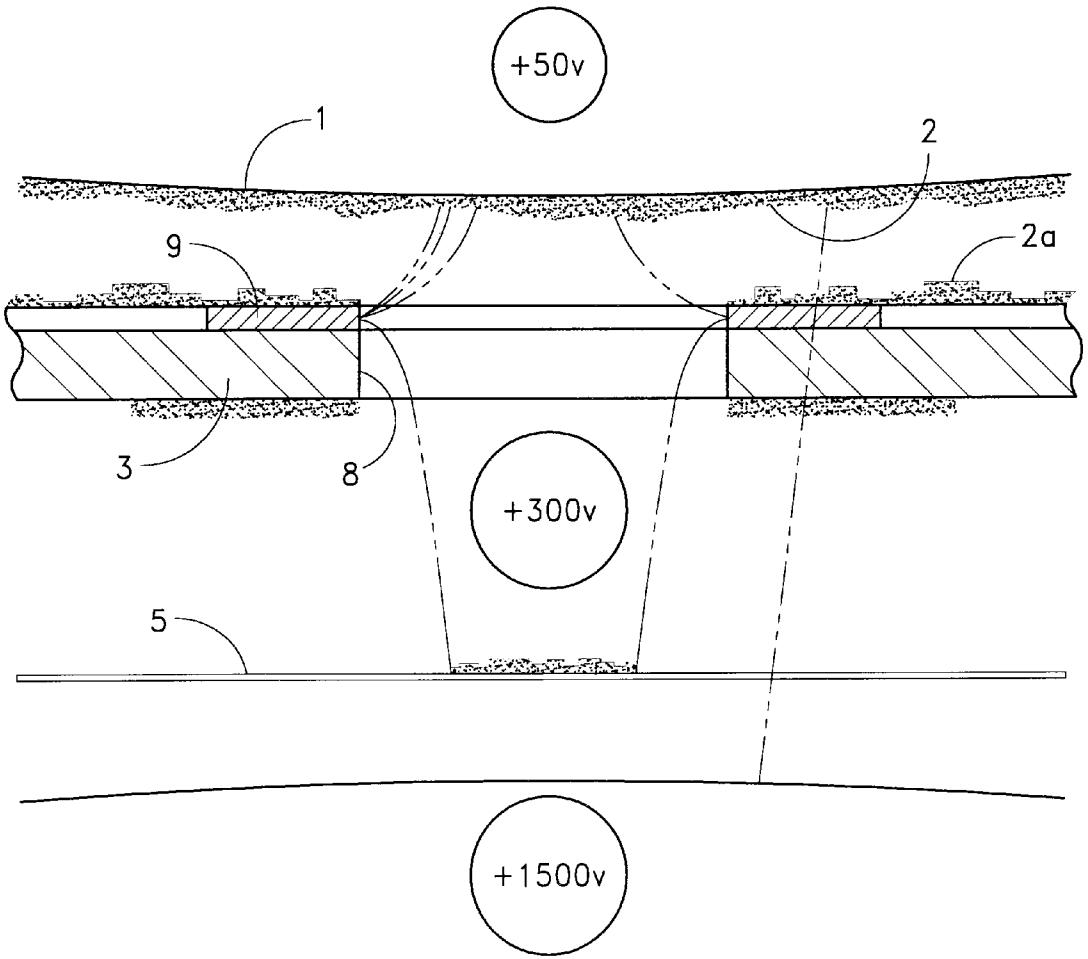
FIG. 2 shows schematically in enlarged scale a cross section view through a printing apparatus of toner-jet type according to the prior art.

In FIG. 2 is diagrammatically shown that some toner particles can be released from the toner feeder roll 1 and may deposit as waste toner 2*a* at the upper surface of the matrix 3. Such waste toner obstacles a feeding down of toner particles through the toner feeder bores of the matrix. In some cases waste toner also may deposit on the bottom surface of the matrix, and such toner may smear off on the paper 5 as a non-desired back ground tone.

Figure 3:
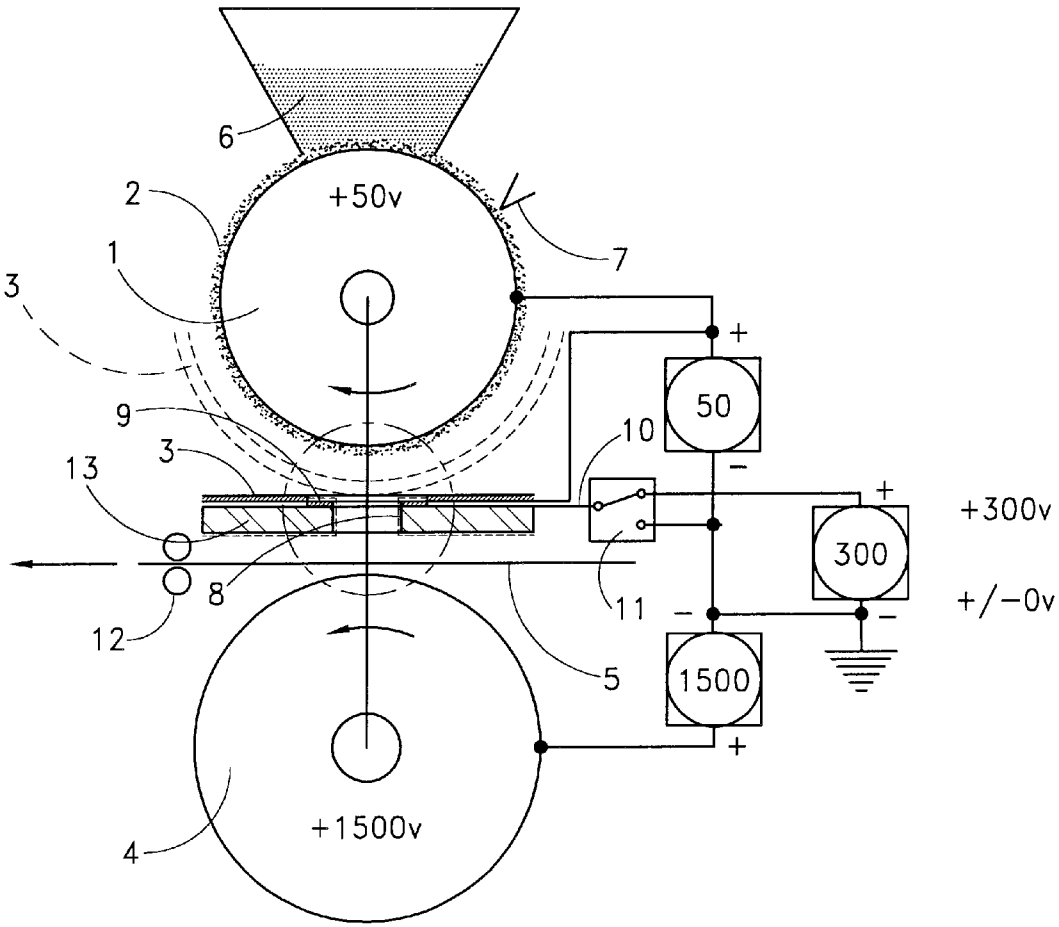
FIG. 3 shows a cross section view through a printing apparatus according to the present invention.
Figure 4:
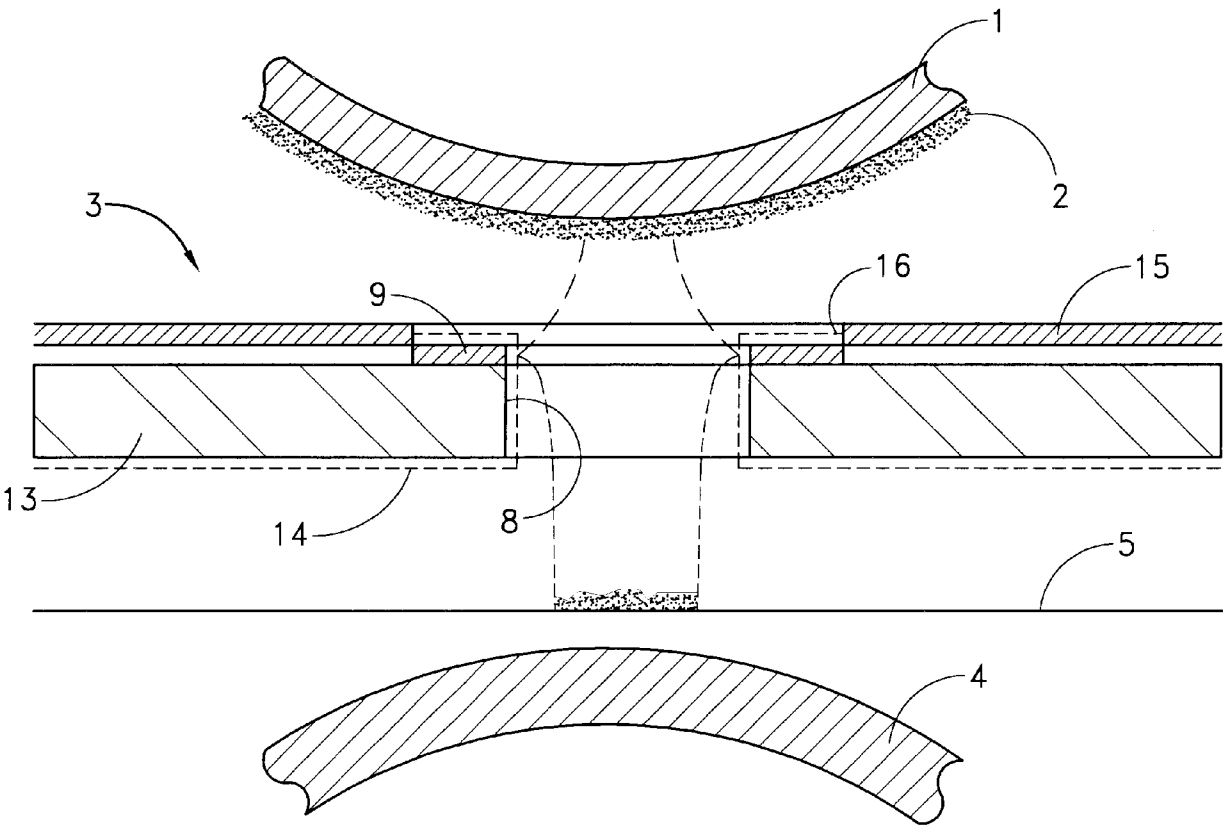
FIG. 4 shows in an enlarged scale the part of FIG. 3 which is encircled by a broken circle.

As shown in FIG. 3 a toner container 6 is mounted above the rotatable toner feeder roll 1, and from said container 6 toner is let down on the toner feeder roll 1. A doctor blade 7 spreads and distributes the toner to form an even layer 2 of toner on the toner feeder roll 1. The toner feeder roll 1 is charged with a certain positive voltage of for instance between +5 and +100V, in the illustrated case a voltage of about +50V. Since the toner particles rub against each other they are charged with a negative polarity, and this makes the toner particles become adhered to the positively charged toner feeder roll.

The matrix 3 is formed with a large number of through bores 8 adapted to let toner through when said bores are in open condition. Said bores can have a diameter of 100–300 μm, in a certain tested matrix a diameter of 190 μm. Round each toner bore 8 there is an electrically conducting ring 9, for instance of copper, for controlling the letting through of toner particles. For enabling a maximum letting down of toner through the toner bores 8 the copper ring is mounted on top of the matrix with its inner diameter flush with the toner bore 8. Each copper ring 9, or control ring, is over conduits 10 electrically connected to a control means 11 which is diagrammatically shown in FIG. 3 and which is arranged to alternatively charge the copper ring either with a voltage which is higher than the voltage of the toner feeder roll 1, for instance a voltage of +300V, whereby the matrix bore is "opened", or with a voltage which is lower than the voltage of the toner feeder roll, in particular a voltage of ±0V, in that the ring is connected to ground, whereby the matrix bore is "closed".

The opening of the toner matrix bore 8 is thus accomplished in that the copper ring 9 is given a potential of for instance +300V, whereby a difference in potential of +300–+50=+250V appears between the toner feeder roll 1 and the matrix 3. Said difference in potential is so great that the negatively charged toner particles are released from the toner feeder roll 1 and are sucked down against the matrix 3 and through the presently opened matrix bores 8. If the copper ring 9 is connected to ground the direction of potential is inversed and there appears an upwardly directed difference in potential of +50V, and toner particles are thereby sucked back towards the toner feeder roll 1, or are kept thereon, respectively. As mentioned above toner particles may, however, be released from the toner feeder roll 1 and deposit on the matrix, or may jump up and down between the toner feeder roll 1 and the matrix 3.

The support roll 4 constantly has a voltage which is higher than the highest voltage, +300V, of the matrix 3, in the illustrated case a voltage of +1500V. In "opened" matrix bores 8 there is consequently a downwards directed difference in potential of +1200V, and said difference makes toner particles become sucked down from the matrix 3 towards the support roll 4. Toner particles deposit as dots on the paper 5 which is moved over the support roll 4. A series of such dots from several matrix bores successively form the image or images to be represented on the paper.

The paper with the toner particles deposited thereon is thereafter passed through a heat treatment apparatus, for instance between two heater rolls 12, in which the toner powder is fixed to the paper.

The distances between the different parts marked in the drawings are, for the sake of clearness, strongly exaggerated. The distance between the toner feeder roll 1 and the matrix 3 can, for instance, be 0.1 mm and the distance between the matrix 3 and the support roll 4 can, for instance, be 0.6 mm.

As indicated with the dotted lines in FIG. 3 the matrix 3 may preferably be bowed in a curvature the axis of which coincides with the axis of rotation for the toner feeder roll 1. For further stabilising the matrix 3 and avoiding vibrations which may bring the bottom surface of the matrix 3 in contact with the paper 5 the bottom surface of the matrix 3 can be laminated with a (not illustrated) metal layer, which is preferably also enclosed in an insulating layer.

For avoiding flash over between the toner feeder roll 1 and the matrix 3 and between the matrix 3 and the support roll 4 the copper rings 9 on top of the matrix 3 have to be insulated. The insulation is accomplished in that the electrically conducting copper rings 9 are connected, in a suitable way, to the upper surface of the matrix base 11, for instance by means of glue or tape, so that the copper ring 9 with the inner diameter thereof is flush with matrix bore 8. Thereafter the entire matrix 3 is covered with a thin layer 14 of an insulation material which covers the entire matrix at the top surface and the bottom surface and also extends over the inner edges both of the matrix bores 8 and the copper rings 9. Such covering can be accomplished by an evaporation process with an insulation substance, whereby said substance encloses all free surfaces of the matrix, the matrix bores and the copper rings. An available method is named the Parylene® method (Union Carbide) according to which process a polymeric insulation material named poly-para-xylene is, in a vacuum apparatus, applied to the matrix in a very accurately controlled layer thickness. The material has an electric decomposition resistance of about 200V/$\mu$m. This means that it is sufficient with a thickness of the insulation layer 14 of only 2 $\mu$m for insulating an electric field of 250V between the toner feeder roll and the copper ring of the matrix. For the sake of safety the material is generally applied in a layer having a thickness of 5–10 $\mu$m. Even using such great thickness of the insulating layer as 10 $\mu$m for a matrix bore 8 having a diameter of 170 $\mu$m and an inner diameter of the copper ring 9 of 190 $\mu$m the specific opening area for the matrix bore 8 for letting toner through is as great as 89,9%. This provides a great margin in printing with the printing apparatus in that a more even print quality can be obtained. At the same time problems depending on variations in moisture and temperature are reduced. It is also possible, thanks to the increase in degree of blackness during the printing, to reduce the drive voltage of the control rings 9 and to increase the tolerances of certain parts included in the apparatus.

For eliminating the problem that toner particles are released from the toner feeder roll 1 and deposit on the upper surface of the matrix 3, and in some cases also the bottom surface of the matrix, or that toner jumps up and down between the toner feeder roll 1 and the matrix 3 there is provided a protective layer 15 of metal on top of the matrix. The protective layer must be made of an unmagnetic metal and can be of stainless steel, beryllium copper, hard nickel, brass, aluminum or another hard, unmagnetic material. The protective layer 15 is formed with through bores 16 equivalent to the bores 8 of the matrix and the bores of the copper rings 9. For foreseeing that the protective metal layer 15 does not provide an electric screen against the copper rings 9 the bores 16 of the protective layer 15 preferably should be at least as large as the outer diameter of the copper rings 9. The protective layer 15 is, via a conduit, charged with the same voltage as that of the toner feeder roll, in the illustrated case a voltage of +50V. Since the toner feeder roll 1 and the protective metal layer 15 has the same voltage and polarity there is no electric field between said parts, and there is consequently no force tending to tear off toner particles from the toner feeder roll. For the same reason it is also not necessary to provide any insulation of the protective metal layer 15.

REFERENCE NUMERALS

| | |
|---|---|
| 1 | toner feeder roll |
| 2 | toner layer |
| 3 | toner matrix |
| 4 | support roll |
| 5 | paper |
| 6 | toner container |
| 7 | doctor blade |
| 8 | toner feeder bore |
| 9 | copper ring |
| 10 | conduit (for 9) |
| 11 | control means |
| 12 | heater rolls |
| 13 | matrix base |
| 14 | insulation layer |
| 15 | protection layer |
| 16 | bore |
| 17 | conduit |

What is claimed is:

1. A printing apparatus comprising:

heat treatment means;

a rotatable feeder roll chargeable to predetermined first potential;

a support roll chargeable to a predetermined second potential; and a matrix in the form of a flexable printing circuit, said matrix having feeder bores, each feeder bore having a first diameter and being surrounded by an electrically conducting control ring configured to be charged to a predetermined third potential and having an inner diameter, said third potential being selected to control corresponding feeder bores between an open state and a closed state, said open state being achieved when said third potential is higher than said first potential and lower than said second potential, and said closed state being achieved when said third potential is lower than said first potential, said matrix having an upper surface which is covered with a protective layer having through holes, each though hole having a second diameter which is at least equal to the inner diameter of the control rings, said protective layer being of a non-magnetic metal and charged with a voltage which is substantially equal to the first potential of the feeder roll, said matrix and said control rings being covered, at upper surfaces and bore edges, with an electrically insulating layer;

wherein said feeder roll, said support roll and said matrix are configured to transfer a dry powder from said feeder roll through said feeder bores the matrix to an object to be printed which is conveyed over said support roll, said powder deposited on the object being fixed by said heat treatment means.

2. The printing apparatus of claim 1, wherein the metallic protective layer includes a hard metal selected from a group including stainless steel, beryllium copper, hard nickel, brass and aluminum.

3. The printing apparatus of claim 1, wherein the inner diameter of each control ring of the matrix is substantially equal to the first diameter of the feeder bore of the matrix.

4. The printing apparatus of claim 3, wherein each electrically conducting control ring is secured directly on top of the matrix with the inner diameter of the control ring flush with the bore of the matrix.

5. The printing apparatus of claim 4, wherein the electrically insulating layer is a layer of a polymeric material having a predetermined thickness.

6. The printing apparatus of claim 5, wherein the polymeric material includes poly-para-xylene.

7. The printing apparatus of claim 4, wherein the insulating material of the matrix is applied by an evaporation method.

8. The printing apparatus of claim 1, wherein the matrix is bent in a curvature, said curvature having an axis which coincides with an axis of rotation of the feeder roll, and wherein the matrix has a stabilizing metal layer at the surface facing the object to be printed.

9. The printing apparatus of claim 1, wherein the inner diameter of each control ring of the matrix is substantially equal to the first diameter of the feeder bore of the matrix.

10. The printing apparatus of claim 9, wherein each electrically conducting control ring is secured directly on top of the matrix with the inner diameter of the control ring flush with the bore of the matrix.

11. The printing apparatus of claim 10, wherein the electrically insulating layer is a layer of a polymeric material having a predetermined thickness.

12. The printing apparatus of claim 11, wherein the polymeric material includes poly-para-xylene.

13. A printing apparatus comprising:

heat treatment means;

a rotatable feeder roll chargeable to a predetermined first potential;

a support roll chargeable to a predetermine second potential; and a matrix in the form of a flexible printing circuit, said matrix having feeder bores, each feeder bore having a first diameter and being surrounded by an electrically conducting control ring configured to be charged to a predetermined third potential and having an inner diameter, the inner diameter of each control ring of the matrix being substantially equal to the first diameter of the feeder bore of the matrix, each electrically conducting control ring being secured directly on top of the matrix with the inner diameter of the control ring flush with the bore of the matrix, said third potential being selected to control corresponding feeder bores between an open state and a closed state, said open state being achieved when said third potential is higher than said first potential and lower than said second potential, and said closed state being achieved when said third potential is lower than said first potential, said matrix having an upper surface which is covered with a protective layer having through holes, each through hole having a second diameter which is at least equal to the inner diameter of the control rings, said protective layer being of a non-magnetic metal, said matrix and said control rings being covered, at upper surfaces and bore edges, with an electrically insulating layer, wherein the electrically insulating layer has an electrical decomposition resistance of about 200 V/$\mu$m, and wherein said layer is applied in a thickness of more than 2 $\mu$m for insulating an electric field of +250 V between the feeder roll and the control ring of the matrix;

wherein said feeder roll, said support roll and said matrix are configured to transfer a dry powder from said feeder roll through said feeder bores the matrix to an object to be printed which is conveyed over said support roll, said powder deposited on the object being fixed by said heat treatment means.

14. The printing apparatus of claim 13, wherein the thickness is about 5–10 $\mu$m.

15. A printing apparatus comprising:

heat treatment means;

a rotatable feeder roll chargeable to a predetermined first potential;

a support roll chargeable to a predetermined second potential; and a matrix in the form of a flexible printing circuit, said matrix having feeder bores, each feeder bore having a first diameter and being surrounded by an electrically conducting control ring configured to be charged to a predetermined third potential and having an inner diameter, said third potential being selected to control corresponding feeder bores between an open state and a closed state, said open state being achieved when said third potential is higher than said first potential and lower than said second potential, and said closed state being achieved when said third potential is lower than said first potential, said matrix having an upper surface which is covered with a protective layer having through holes, each through hole having a second diameter which is at least equal to the inner diameter of the control rings, said protective layer being of a non-magnetic hard metal selected from a group including stainless steel, beryllium copper, hard nickel, brass and aluminum, said protective layer being charged with a voltage which is substantially equal to the first potential of the feeder roll, said matrix and said control rings being covered, at upper surfaces and bore edges, with an electrically insulating layer;

wherein said feeder roll, said support roll and said matrix are configured to transfer a dry powder from said feeder roll through said feeder bores the matrix to an object to be printed which is conveyed over said support roll, said powder deposited on the object being fixed by said heat treatment means.

16. The printing apparatus of claim 15, wherein the inner diameter of each control ring of the matrix is substantially equal to the first diameter of the feeder bore of the matrix.

17. The printing apparatus of claim 6, wherein each electrically conducting control ring is secured directly on top of the matrix with the inner diameter of the control ring flush with the bore of the matrix.

18. The printing apparatus of claim 17, wherein the electrically insulating layer is a layer of a polymeric material having a predetermined thickness.

* * * * *

UNITED STATES PATENT AND TRADEMARK OFFICE

CERTIFICATE OF CORRECTION

PATENT NO. : 6,406,132 B1
DATED : June 18, 2002
INVENTOR(S) : Per Sundstrom

It is certified that error appears in the above-identified patent and that said Letters Patent is hereby corrected as shown below:

Column 8,
Line 58, change "claim 6" to -- claim 16 --.

Signed and Sealed this

Twenty-sixth Day of November, 2002

*Attest:*

*Attesting Officer*

JAMES E. ROGAN
*Director of the United States Patent and Trademark Office*